United States Patent [19]

Wingard

[11] Patent Number: 4,595,928

[45] Date of Patent: Jun. 17, 1986

[54] BI-DIRECTIONAL ANTENNA ARRAY

[76] Inventor: Jefferson C. Wingard, Rte. #1 Country Pl., Anderson, S.C. 29621

[21] Appl. No.: 974,066

[22] Filed: Dec. 28, 1978

[51] Int. Cl.[4] ..... H01Q 3/24; H01Q 7/00

[52] U.S. Cl. ..... 343/742; 343/876

[58] Field of Search ..... 343/728, 854, 727, 726, 343/742, 741, 876

[56] References Cited

U.S. PATENT DOCUMENTS

| | | | |
|---|---|---|---|
| 2,256,619 | 9/1941 | Luck | 250/11 |
| 2,419,539 | 4/1947 | Clark et al. | 343/728 |
| 3,267,419 | 8/1966 | Silverstein | 343/873 |
| 3,284,801 | 11/1966 | Bryant | 343/742 |

FOREIGN PATENT DOCUMENTS 362530 12/1931 United Kingdom .

*Primary Examiner*—Eli Lieberman

*Attorney, Agent, or Firm*—Cort Flint

[57] ABSTRACT

A bi-directional antenna array is disclosed having at least two vertical loop antennas arranged mutually perpendicular individually operable to produce bi-directional scanning patterns shifted ninety degrees to achieve significant side rejection so that a user can better utilize the congested frequency spectrum.

7 Claims, 5 Drawing Figures

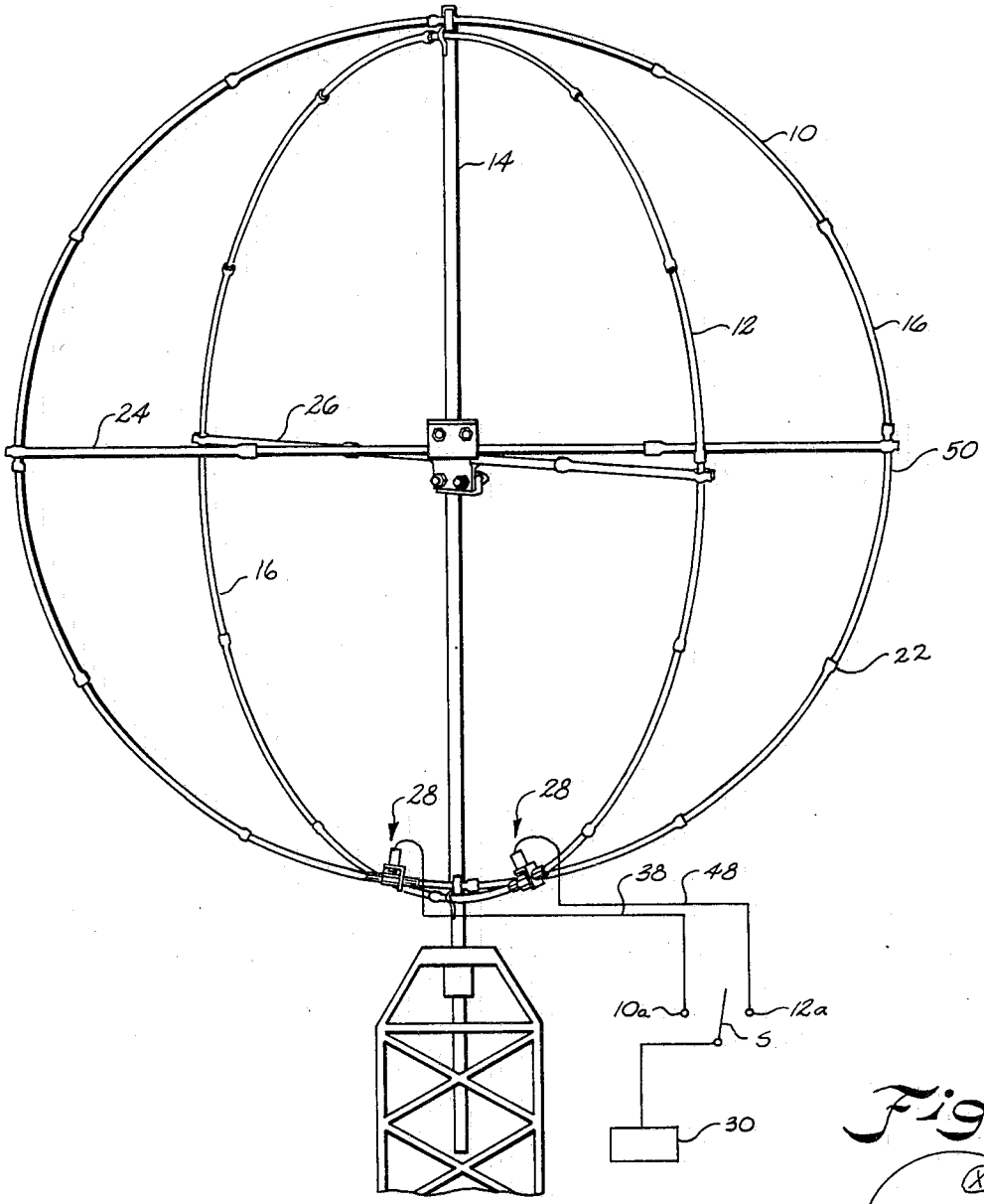
Fig. 1
Fig. 2
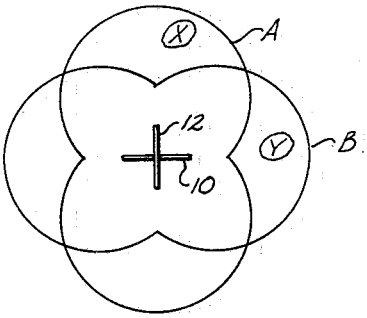
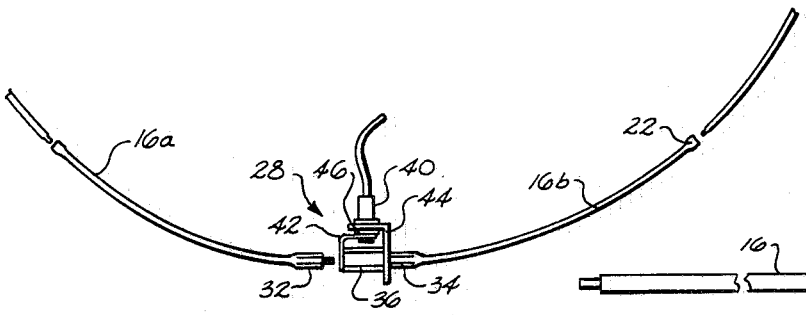
Fig. 3
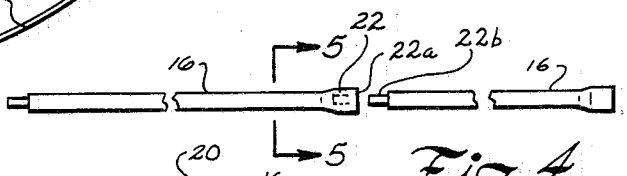
Fig. 4
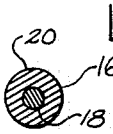
Fig. 5

BI-DIRECTIONAL ANTENNA ARRAY

BACKGROUND OF THE INVENTION

A previous loop antenna is disclosed in U.S. Pat. No. 2,256,619 which discloses an antenna having one loop in the vertical plane and one loop in the horizontal plane and a dipole antenna arranged vertically through the center area. However, this arrangement is directed mainly to providing a directional system which can find either vertically or horizontally polarize waves and does not provide significant side rejection for use in congested areas. Another prior loop antenna is disclosed in British Pat. No. 362,530 which is directed to the provision of a non-directional or omini antenna by utilizing shortened loops turned by an electrical circuit to compensate for the impedance mismatch caused by the shortened loops and does not provide significant side rejection in either plane.

SUMMARY OF THE INVENTION

It has been found according to the invention that a highly versatile antenna can be had by providing a pair of large circular loop elements carried vertically on a base axis with the planes of the respective loops being mutually perpendicular to one another whereby the antenna can be operated to produce a bi-directional scanning pattern by selectively driving either loop either vertically or horizontally providing a high degree of side rejection of unwanted signals to better utilize the congested frequency spectrum.

Accordingly, an important object of the present invention is the provision of a versatile antenna system with which a radio operator may better utilize a congested frequency spectrum.

Another important object of the present invention is the provision of an antenna array which produces a bi-directional pattern moving out from the antenna element equally in opposite directions wherein the bi-directional pattern may be shifted in direction to provide a scanning antenna.

Another important object of the present invention is the provision of a large loop antenna wherein the loop element is formed by a unique and improved construction.

Another important object of the present invention is the provision of an antenna array having particular advantages for citizens band radio usage having a pair of mutually perpendicular large vertical loops which may be individually driven and manually switched to provide bi-directional scanning patterns either vertically or horizontally polarized affording significant side rejection of unwanted signals.

BRIEF DESCRIPTION OF THE DRAWINGS

FIG. 1 is a perspective view illustrating a bi-directional antenna array constructed in accordance with the invention;

FIG. 2 is a schematic illustration of the bi-directional pattern produced by the antenna array of FIG. 1;

FIG. 3 is an enlarged view illustrating the individual radiating sections which comprise the loop elements of a bi-directional antenna array according to the invention;

FIG. 4 is an enlarged view of a pair of joining radiating sections; and

FIG. 5 is a sectional view taken along line 5—5 of FIG. 4.

DESCRIPTION OF A PREFERRED EMBODIMENT

Referring to the drawing, a bi-directional antenna array is illustrated which, in its basic design, includes at least two vertical large loops 10 and 12 arranged mutually perpendicular to one another and supported by a base axis 14. The base axis lies generally in the vertical plane of both loops. In the preferred form, the loops are circular in shape. As illustrated, each circular loop element is constructed from a plurality of individual flexible radiating sections 16.

Each section 16 includes a center conductor core 18 which may be made of any suitable electrical conductor such as aluminum or copper and the like. The center core 18 is encapsulated by an outer layer 20 made from a suitable dielectric material which is preferably reinforced such as a reinforced fiberglass composite giving the section structural rigidity and allowing it to bend to form the circular or other closed-curve loop configuration. The ends of the individual radiating sections 16 may be joined by any suitable means such as a pressure-fit ferrule connection 22 having a socket **22*a* and a plug 22*b*. The socket and plug of the ferrule connection are conductive and are connected to the conductive center core 18** of the radiating section so that a continuous conductive path may be established around the loop when joined together.

Not only does the construction of the individual radiating sections 16 provide advantageous structural characteristics to the antenna, but such a construction mutually insulates the loops against one another in their contact area adjacent the top and bottom of the antenna array and enables the antenna to be assembled with conventional mechanical hardware. Thus, insulating hardware such as at cross arms 24 and 26 as well as at the other various connection points which has been required in previous large loop antennas is eliminated. The base axis 14 may be joined to the loop elements 10 and 12 and the cross arms 24 and 26 by any conventional hardware as shown.

The individual elements may be four or five feet in length for convenience in shipping and assembly and are approximately ¼ of an inch in diameter. Shortened sections, approximately two feet, may be supplied to adjust the loop size and characteristic as desired. In one embodiment, loop elements twelve feet in diameter are utilized at a frequency of 30 megacycles whereby the loops correspond in circumference to a one-wave length loop element.

Electrical terminal connections to the loop elements 10 and 12 at switching terminals **10*a* and 12*a* may be made by any suitable means such as by the terminal connectors shown generally at 28. Two of the radiating sections 16*a* and 16*b* are specially adapted for making connection to a power source 30 such as a radio. For this purpose, the terminal end of these sections are provided with a threaded electrical connector 32 and 34, respectively, affixed to the ends of each section which may be threaded into a dielectric block member 36. Coaxial cable lead 38, connected between switch terminal 10*a* and connector 28 is received within female connector portion 40 of the connector means 28. The center conductor of the coaxial makes electrical connection with section 16*a* through the conductive connector 42 and connector 32. The outside conductor of coaxial cable 38 makes electrical connection with element 16***b* through conductive connectors 44 and 34. Members 36 and 46 are insulating members. A similar connection is made between switching terminal 12*a* and connector means 28 of loop element 12 by means of coaxial cable lead 48. It is to be understood, of course, that other suitable hardware may also be utilized from making the aforesaid electrical and mechanical connections.

The vertical loop antenna elements 10 and 12 so arranged provide the respective bi-directional patterns A and B, respectively, as shown in FIG. 2. The antenna array may be oriented such that pattern A is a typical North-South pattern and pattern B is an East-West pattern. As illustrated, the terminals of the loop elements are at the bottom and the radiation is horizontally polarized. When the terminals are moved to the quadrants on the side of the loops, such as at 50, the radiation will be vertically polarized. It is contemplated that the basic antenna array as illustrated may also be operated wherein one loop is driven horizontally and the other perpendicular loop is driven vertically. However, in such instance, a light rotor may be required to provide the desired performance. Since one of the objects of the present invention is to provide a simple antenna arrangement which does not require a rotor for good performance and side rejection, the following operation and explanation of the invention will be with reference to both loops being either horizontally or vertically polarized.

Operation of the antenna array as a manually scanning bi-directional antenna will now be explained. It will be seen that if a manual switch S is provided, the antenna loop elements 10 and 12 may be selectively connected to the radio 30 and operated to produce either bi-directional scanning pattern A or B. Bi-directional pattern A produced by antenna element 10 has a major signal load extending equally in opposite directions, North and South, from the base axis and a minor signal load in an East-West direction generally perpendicular to the major signal load direction. The second bi-directional pattern B produced by the antenna element 12 has a major signal load in the East-West direction extending generally equally in opposite directions from the base station and a minor signal in the North-South direction generally perpendicular to the major signal load. The radiation is maximum perpendicular to the plane of the loop and is minimum in any direction in the plane containing the loop.

It will be seen that with the loop antenna elements arranged on the base axis mutually perpendicular to one another the antenna element may be selectively operated to produce either of the bi-directional scanning patterns A or B to the exclusion of a significant portion of the nonselected pattern affording a high degree of side rejection of unwanted signals and better utilization of a congested frequency spectrum such as citizen band operation. For example, if a radio operator using the antenna array at a base unit wishes to communicate with another party at X, the operator may select pattern A while another party utilizing the same frequency at Y will manage to do so without interfering with the use of the same frequency by the base operator. This simultaneous usage of the frequency spectrum is achieved because of the significant side rejection of the pattern B achieved by utilizing pattern A. Thus, in this manner, the antenna may be used as a manual scanning antenna by shifting between the bi-directional patterns A and B. Side rejection of 25 db may be achieved in accordance with the invention. Any suitable coaxial switch may be utilized at S such as Model 442 coaxial switch manufactured by the Winn-Tenna Corporation of Anderson, S.C.

The antenna so described has the advantages of a directional antenna but is essentially a bi-directional antenna in that an equal signal is produced in the pattern in the opposite directions eliminating the need for a rotor.

It can be seen that an advantageous construction for a large closed loop antenna can be had according to the invention wherein a pair of perpendicular loop elements are arranged and adapted for shifting between a pair of bi-directional scanning patterns with significant side rejection achieved to better utilize a congested frequency spectrum.

While a preferred embodiment of the invention has been described using specific terms, such description is for illustrative purposes only, and it is to be understood that changes and variations may be made without departing from the spirit or scope of the following claims.

What is claimed is:

1. A bi-directional array for scanning a bi-directional pattern to better utilize a congested frequency spectrum comprising:

a base axis;

a first continuously curved loop antenna element vertically carried by said axis;

a second continuously curved loop antenna element carried vertically by said base axis;

said base axis lying in the plane of both said first and second loop elements;

input terminal means connected to said first and second antenna elements adopted for connection to a radiation source;

a first bi-directional pattern radiated by said first antenna elements adopted for connection to a radiation source;

a first bi-directional pattern radiated by said first antenna element having a major signal load extending generally equally in opposite directions from said base axis and a minor signal load in a direction generally perpendicular to said major signal load direction;

a second-bi-directional pattern radiated by said second antenna element having a major signal load extending generally equally in opposite directions from base axis, and a minor signal load in a direction generally perpendicular to said major signal load;

said first and second antenna loop elements carried about said base axis with the vertical planes of said loop elements mutually perpendicular to one another and adapted so that either antenna element may be selectively operated to produce either of said bi-directional patterns to the exclusion of a significant position of the non-selected pattern affording a high degree of side rejection so that a congested frequency spectrum may be better utilized and said loop elements including a plurality of individual flexible generally straight sections, each section including a center conductive core encapsulated by an outer layer of dielectric materal affording structural rigidity and enabling said sections to bend and be joined end-to-end to form said curved loop configuration and to be resilient for disassembly thereafter.

2. The apparatus of claim 1 including mannual switch means connected to said input terminal means for selectively connecting either of said loop antenna elements to a radio as desired to shift to either of said bi-directional patterns for manual scanning.

3. The apparatus of claim 1 wherein said first and second loop antenna elements have a circumference equal to one wavelength at their operating frequency.

4. The apparatus of claim 1 wherein said first and second loop antenna elements have a closed continuously curved form and include:

plurality of straight sections;

each section including a conductive center core and an outer layer of reinforced fiberglass composite affording structural integrity to each section and affording flexibility enabling said sections to bend and assume said continuously curved shape when joined to one another; and connector means carried adjacent free ends of said sections for joining adjacent sections to one another in a conductive manner enabling the center core of said sections to establish a continuous conductive path.

5. The structure of claim 1 wherein each said loop elements is adapted for selective quadrant connection enabling each said loop to be horizontally or vertically polarized.

6. An antenna having at least one continuously curved closed loop antenna element comprising:

a plurality of straight flexible sections bendable to form said closed continuously curved loop element;

each said section including a center conductive core;

7. The structure of claim 6 wherein said dielectric composite includes reinforced fiberglass.

* * * * *